US007072610B2

(12) United States Patent
Nakane

(10) Patent No.: US 7,072,610 B2
(45) Date of Patent: Jul. 4, 2006

(54) FIXING APPARATUS HAVING A BYPASS TRANSPORT PATH AND IMAGE FORMING APPARATUS INCLUDING THE FIXING APPARATUS

(75) Inventor: Yoshimitsu Nakane, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/093,060

(22) Filed: Mar. 29, 2005

(65) Prior Publication Data

US 2005/0220477 A1 Oct. 6, 2005

(30) Foreign Application Priority Data

Apr. 2, 2004 (JP) ..... 2004-110183

(51) Int. Cl.
*G03G 15/20* (2006.01)

(52) U.S. Cl. ..... 399/328; 399/92

(58) Field of Classification Search ..... 399/68, 399/92, 45, 322, 400, 328, 320, 67
See application file for complete search history.

(56) References Cited

U.S. PATENT DOCUMENTS 6,512,914 B1 1/2003 Kabashima
6,980,762 B1 * 12/2005 Bogoshian ..... 399/328
2003/0180074 A1 * 9/2003 Noya et al. ..... 399/328
2004/0131378 A1 * 7/2004 Hattori et al. ..... 399/107

FOREIGN PATENT DOCUMENTS

JP 6-348159 A 12/1994
JP 7-191564 A 7/1995
JP 7-271226 A 10/1995
JP 5-158364 A 1/2001
JP 2001-005319 A 1/2001

* cited by examiner

*Primary Examiner*—David M. Gray
*Assistant Examiner*—Ruth N. LaBombard
(74) *Attorney, Agent, or Firm*—Canon USA Inc IP Division

(57) ABSTRACT

A fixing apparatus includes a plurality of fixing devices that fix a toner image on a sheet, a bypass transport path which bypasses at least one fixing device among the plurality of fixing devices and which transports the sheet, a main transport path which transports a sheet via the fixing device that the sheet transported by the bypass transport path bypasses, and a heat insulator that prevents heat generated from the fixing device that the sheet transported by the bypass transport path bypasses from being transmitted to the bypass transport path.

19 Claims, 11 Drawing Sheets

FIXING APPARATUS HAVING A BYPASS TRANSPORT PATH AND IMAGE FORMING APPARATUS INCLUDING THE FIXING APPARATUS

BACKGROUND OF THE INVENTION

1. Field of the Invention

The present invention relates to a fixing apparatus for fixing a toner image on a sheet and an image forming apparatus provided with this fixing apparatus.

2. Description of the Related Art

In an image forming apparatus, generally, an unfixed image formed on a sheet by toner is heated and pressed in a fixing device, and is fixed on the sheet surface. The fixing device is heated by an inside heater, and the heater is controlled to maintain a temperature necessary for fixation while supplementing heat quantity absorbed by a sheet that passes through there.

Kinds of a sheet material transported by an image forming apparatus have been increased year by year, and in a structure in which image fixation is performed in one fixing device, it has become difficult to make a stable fixing characteristic, good quality of a fixed image, and their productivity consistent with each other for all of these materials. In order to cope with this circumstance, a technique has been employed in which a plurality of fixing devices are arranged in series on a transport path to avoid a problem caused by the structure of one fixing device, such as lack of heat quantity (Japanese Patent Application Laid-Open No. 6-348159 and Japanese Patent Application Laid-Open No. 7-271226).

Meanwhile, there are materials, such as paper called a plain paper whose basis weight is small and a second surface of a thick paper (where the water content has decreased and the sheet temperature has increased), which fixing can be sufficiently performed with only one fixing device, and such a material of sheet could wind around a curl or a fixing roller because an excess heat quantity is applied thereto when it passes through two or more fixing devices. In order to cope with a problem about such a material, it has been considered to provide a bypass transport path that bypasses a fixing device on a downstream side among a plurality of fixing devices and thus branches from a main transport path that passes through two fixing devices. In the way the material, which causes the problem when it passes through two or more fixing devices, passes through the bypass transport path (U.S. Pat. No. 6,512,914, Japanese Patent Application Laid-Open No. 2001-005319, Japanese Patent Application Laid-Open No. 5-158364, and Japanese Patent Application Laid-Open No. 7-191564).

However, in a case where the bypass transport path is heated by convection heat coming from a fixing device that the bypass transport path bypasses, a problem as described below occurs. Since heating of the fixing device is carried on regardless of whether the image forming apparatus is in a standby state or in an image forming state, the bypass transport path is constantly heated by the fixing device that the bypass transport path bypasses while the image forming apparatus is turned on.

In the case, when the bypass transport path is heated, the bypass transport path comes in contact with a sheet passing through the bypass transport path, and toner which has been fixed already on a sheet melts again, resulting in image deterioration. Besides, the melted toner sticks to the bypass transport path, and due to this sticking toner, a jam occurs. Further, the melted toner adheres to a transport roller provided in the bypass transport path and causes contamination on the transport path, so that a transport defect occurs or frequent service maintenance is required.

SUMMARY OF THE INVENTION

It is an aspect of the present invention to provide a fixing apparatus that has a bypass transport path bypassing at least one fixing device among a plurality of fixing devices and which can prevent image deterioration, transport defects, or the like from occurring, which appear in the bypass transport path influenced by heat from a fixing device that the bypass transport path bypasses.

A fixing apparatus according to an aspect of the present invention includes two fixing devices that fix a toner image on a sheet using heat, a main transport path that transports the sheet via the two fixing devices, a bypass transport path which branches from the main transport path and transports the sheet so that the sheet bypasses one of the two fixing device, and a fan that moves air between the fixing device that the sheet transported by the bypass transport path bypasses and the bypass transport path.

A fixing apparatus according to another aspect of the present invention includes two fixing devices that fix a toner image on a sheet using heat, a main transport path that transports the sheet via the two fixing devices, a bypass transport path which branches from the main transport path and transports the sheet so that the sheet bypasses one of the two fixing devices, and a heat insulator that prevents heat generated from the fixing device that the sheet transported by the bypass transport path bypasses from being transmitted to the bypass transport path.

A fixing apparatus according to another aspect of the present invention includes a plurality of fixing devices that fix a toner image on a sheet using heat, a bypass transport path that transports the sheet so that the sheet bypasses at least one fixing device among the plurality of fixing devices, a main transport path that transports the sheet via the fixing device that the sheet transported by the bypass transport path bypasses, and a heat insulator that prevents heat generated from the fixing device that the sheet transported by the bypass transport path bypasses from being transmitted to the bypass transport path.

Other features and advantages of the present invention will become apparent to those skilled in the art upon reading of the following detailed description of embodiments thereof when taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE EMBODIMENTS

Embodiments of the invention will be described in detail below with reference to the drawings.

First Embodiment

A first embodiment of the present invention is described below.

Figure 1:
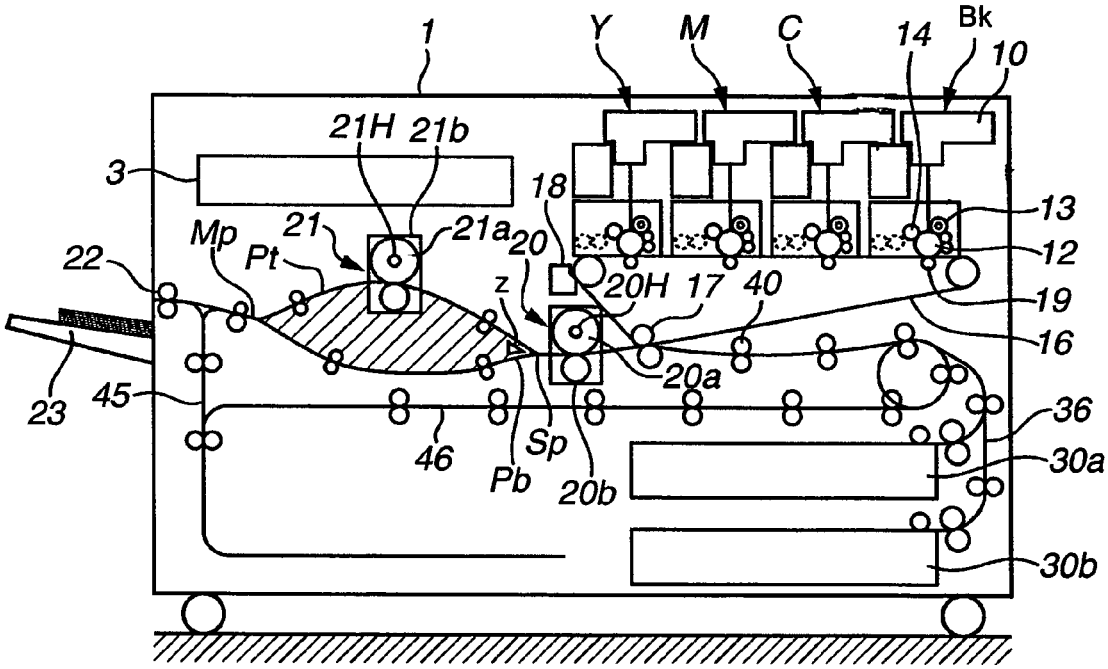
FIG. 1 is a schematic cross-sectional view of an image forming apparatus according to a first embodiment of the present invention.

FIG. 1 is a schematic cross-sectional view of an image forming apparatus according to the first embodiment of the present invention.

FIG. 1 shows a printer main body 1. Primary image forming sections Y, M, C, and BK for forming primary images of respective yellow, magenta, cyan, and black colors are arranged in an upper part of the printer main body 1. Print data transmitted from external equipment such as a personal computer is received in a controller 3 controlling the printer main body 1 and is output to laser scanners 10 of the respective colors as image data for writing.

The laser scanners 10 emit laser beams to upper sides of photosensitive drums 12 to draw light images according to the image data for writing.

Each of the primary image forming sections Y, M, C, BK is composed of the photosensitive drum 12, a charger 13 for uniformly electrifying the surface of the photosensitive drum 12, a developing device 14 for developing an electrostatic latent image formed by the laser scanner 10 which draws a light image on the surface of the photosensitive drum 12 electrified by the charger 13, to a toner image which is to be transferred to an intermediate transfer belt 16, a primary transfer roller 19 for transferring the toner image developed on the surface of the photosensitive drum 12 to the intermediate transfer belt 16, and a cleaner (not shown) for removing toner remaining on the photosensitive drum 12 after transferring the toner image.

In FIG. 1, although reference numerals are designated for explanation to the primary image forming section Bk which forms a black image, all of the other primary image forming sections (the primary image forming section Y of yellow, the primary image forming section M of magenta, and the primary image forming section C of cyan) have a structure similar to that of the black primary image forming section Bk. Toner images of the respective colors are transferred on the intermediate transfer belt 16 by the respective primary image forming sections Y, M, C, and Bk. That is, toner images are sequentially superimposed and transferred by the primary image forming sections Y, M, C, and Bk on the outer surface of the intermediate transfer belt 16 so that a synthesized color toner image in accordance with a color image to be achieved is formed on the outer surface of the intermediate transfer belt 16.

The synthesized color toner image which is primarily transferred on the intermediate transfer belt 16 is transferred on a sheet by a secondary transfer roller 17. Residual toner which has not been transferred by the secondary transfer roller 17 is collected by a cleaner 18. An image forming unit is composed of the primary image forming sections Y, M, C, and BK for forming primary images, the intermediate transfer belt 16, and the secondary transfer roller 17.

Paper feeding sections 30*a*, 30*b* are positioned on a most upstream side of a sheet transport and, in a printer of this embodiment, are arranged at upper and lower positions in a lower part of the unit. A sheet fed from the paper feeding section 30*a* or 30*b* is transported to a downstream side via a vertical transport path 36. There is a pair of registration rollers 40 at most downstream positions of the vertical transport path 36, and a final diagonal compensation for a sheet and an adjustment of timing of image writing in the image forming sections and the sheet transport are carried out in the registration rollers.

A first fixing device 20 for fixing a toner image on a sheet as a permanent image and a second fixing device 21 for performing additional fixing for the sheet, if necessary, which has passed through the first fixing device 20 are provided on downstream sides of the image forming sections.

The first fixing device 20 is provided with a case 20*b*, and a first fixing roller pair 20*a* is provided inside the case 20*b*. The first fixing device 20 fixes a toner image transferred by the image forming sections on a sheet by heat from a heating unit 20H and pinching pressure of the first fixing roller pair 20*a*.

The second fixing device 21 has a structure similar to that of the first fixing device 20. That is, the second fixing device 21 is provided with a case 21*b*, and a second fixing roller pair 21*a* is provided inside the case 21*b*. The first fixing device 21 fixes a toner image by heat from a heating unit 21H and pinching pressure of the second fixing roller pair 21*a* in order to further improve the fixing of a sheet on which an image was fixed by the first fixing device 20.

A sheet transport path branches at a diverging point Sp to a main path Pt that is a main transport path going to the second fixing device 21 and a bypass Pb that is a bypass transport path bypassing the second fixing device 21 on a downstream side of the first fixing device 20. The main path Pt and the bypass Pb merge again at a merging point Mp on a downstream side of the second fixing device 21.

A flapper Z is a transport path switching mechanism and switches between the main path Pt and the bypass Pb. The flapper z is provided at the diverging point Sp between the main path Pt and the bypass Pb. By swinging the flapper Z in response to a demand signal from the controller 3, it is possible to select either the main path Pt or the bypass Pb to which a sheet is transported.

Discharge rollers 22 are provided on a downstream side of the merging point Mp where the main path Pt and the bypass Pb meet. A reversal transport path 45 also serves as an inlet toward a transporting path 46 for two-sided printing and discharge rollers 22, from the printer main body 1, the sheet on which an image is fixed. A discharge tray 23 for receiving the sheet discharged by the discharge rollers 22 is mounted on the outside of the printer main body 1. In order to form an image on a second surface of the sheet, the sheet is transported to the reversal transport path 45 to be reversed and passes through the transporting path for two-sided print 46 to be guided to the image forming sections again.

In a case of a material such as a plain paper or a second surface of a thick paper in which the fixing can be sufficiently performed with only one fixing device, and which causes a problem that such a material of sheet winds around a curl or a fixing roller when it passes through two or more fixing devices so that an excess heat quantity is applied thereto, the paper passes through the bypass Pb to bypass the second fixing device 21. A material whose fixing should be improved by making the material pass through both of the first fixing device 20 and the second fixing device 21 is made to pass through the main path Pt.

Figure 2:
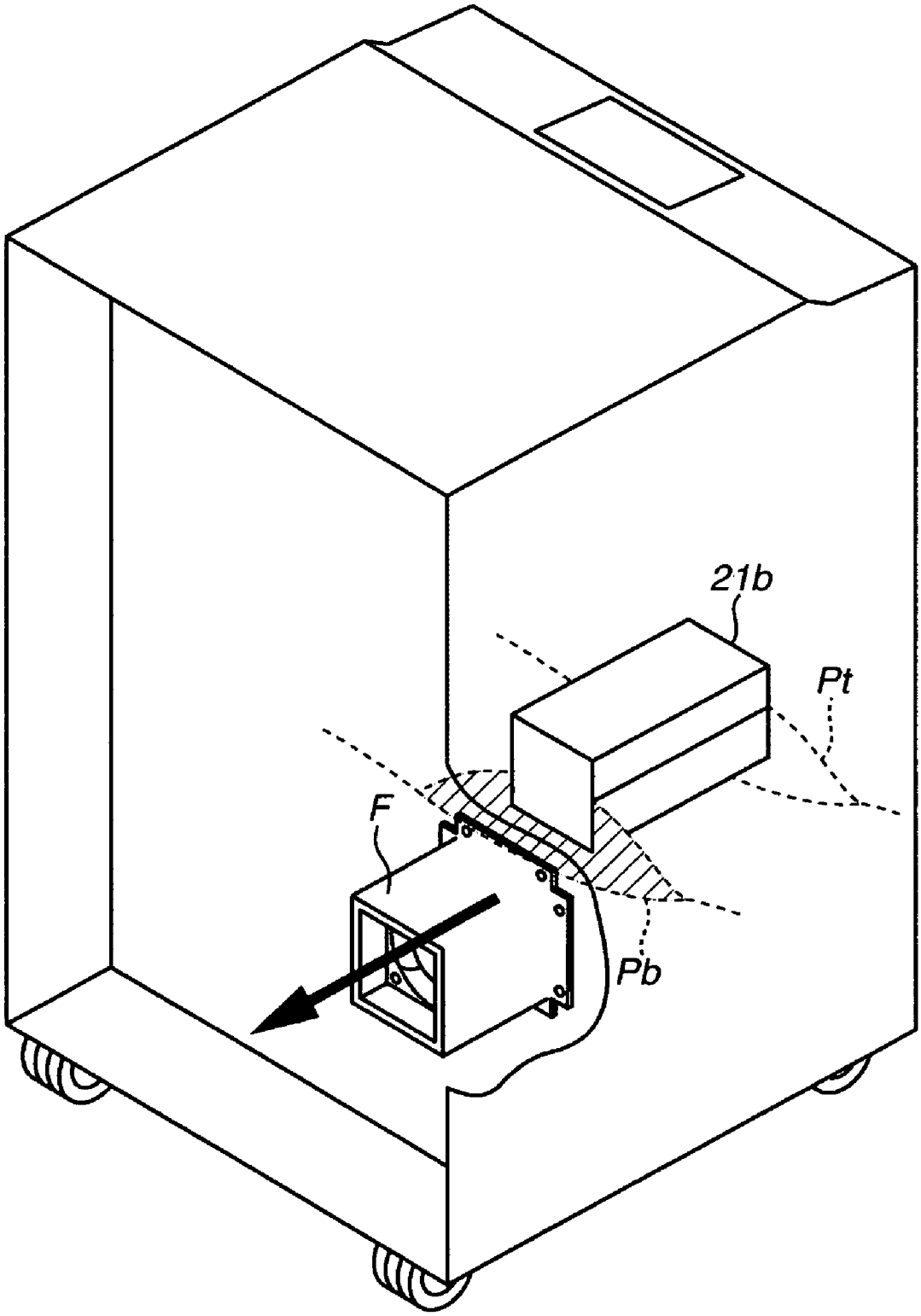
FIG. 2 is a perspective view of the image forming apparatus according to the first embodiment.
Figure 3:
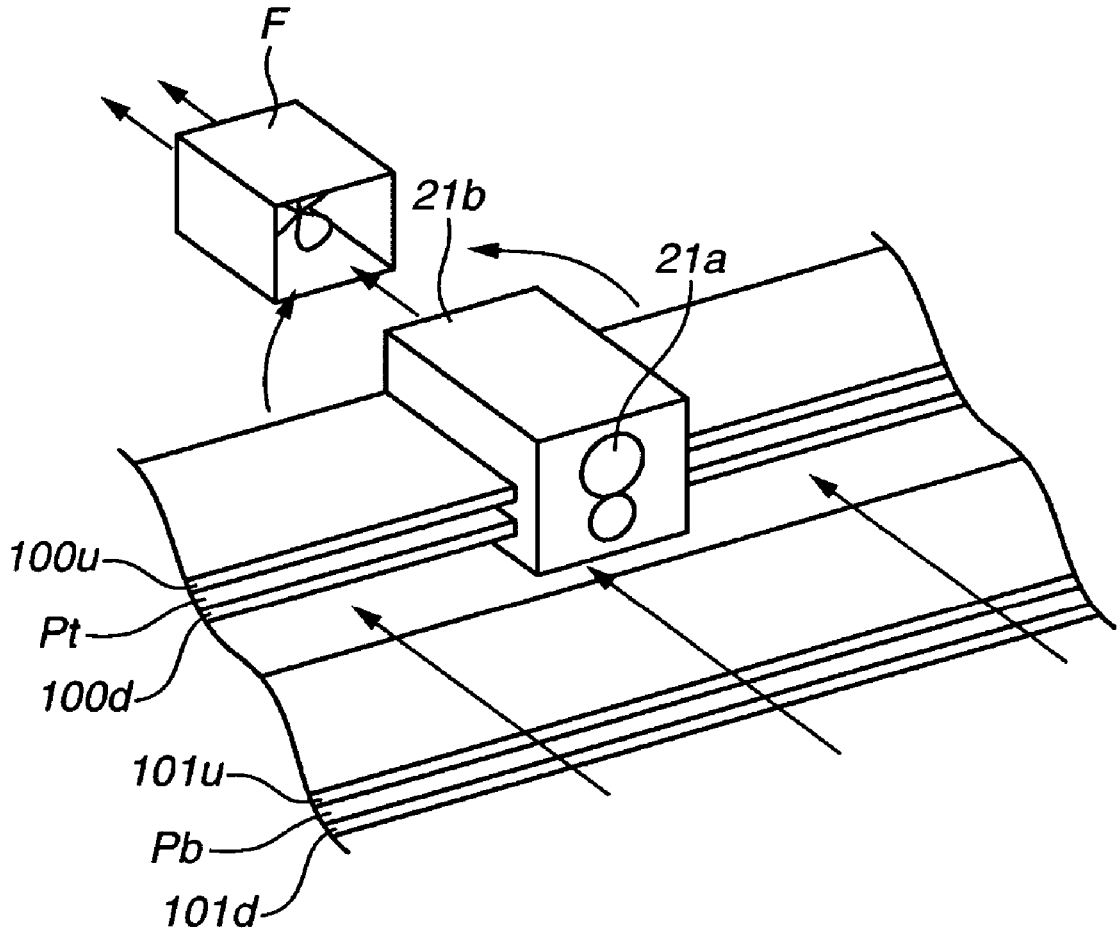
FIG. 3 is a perspective view showing a structure of a periphery of a second fixing device in the first embodiment.

Details of a fixing apparatus according to the present invention are described next. FIG. 2 is a perspective view schematically showing an image forming apparatus 1 where the image forming apparatus 1 is viewed from the back side thereof. FIG. 3 is a perspective view showing a structure of a periphery of the second fixing device 21.

As shown in FIGS. 1 and 2, the bypass Pb is provided outside of a projection area located vertically in an upper direction with respect to the second fixing device 21 that the bypass Pb bypasses. That is, the bypass Pb is provided such that the sheet passes through a portion under the second fixing device 21. In such an arrangement, the temperature inside the bypass Pb is prevented from increasing due to heat of the second fixing device 21. Accordingly, the temperature of the bypass Pb is prevented from going up and the toner image fixed on a sheet by the first fixing device 20 is prevented from melting caused by the heated bypass Pb so that image deterioration due to the melting is prevented. Therefore, even in a case where the sheet Sdoes not pass through the second fixing device 21 but passes through the bypass Pb, the sheet can be transported smoothly.

In the first embodiment, in order to further reduce the influence of the heat of the second fixing device 21 over the bypass Pb, a heat exhausting mechanism for the second fixing device 21 is provided. As shown in FIGS. 2 and 3, in the fixing apparatus a fan F is provided, which constitutes a heat discarding mechanism for discarding heat by conveying air between the second fixing device 21 and the bypass Pb.

The fan F absorbs and moves the air in a cross-section area shown by the shaded portions of FIGS. 1 and 2. By the fan F the air between the second fixing device 21 and the bypass Pb is moved toward a rear portion of the image forming apparatus 1. That is, the fan F moves the air of the cross-section area shown by the shaded portions in FIGS. 1 and 2 to generate an air stream which moves the air to the outside of the image forming apparatus 1. Since the air between the second fixing device 21 and the bypass Pb moves, the heat in the space between the second fixing device 21 and the bypass Pb whose heat source is the second fixing device 21 is exhausted. Fan F prevents heat generated from the second fixing device 21 from being transmitted to the bypass Pb.

The heat discarding mechanism will be described further with reference to FIG. 3.

As shown in FIG. 3, the main path Pt is formed by a guide 100*u* over the main path and a guide 100*d* under the main path. The bypass Pb is formed by a topside guide 101*u* of the bypass and an underside guide 101*d* of the bypass.

The air between the second fixing device 21 and the bypass Pb is moved in directions shown by the arrows in FIG. 3 by the fan F. That is, by the fan F the air stream is generated which approximately parallels the axis of the second fixing roller pair 21*a* of the second fixing device 21. An under-surface of the guide 100*d* under the main path, an under-surface of the case 21*b* of the second fixing device 21, and an upper surface of the topside guide 101*u* of the bypass constitute a flow path (duct) of when the air is moved by the fan F.

Since the heat in the space between the second fixing device 21 and the bypass Pb is exhausted by the fan F, increase of the temperature of the bypass Pb due to the heat of the second fixing device 21 as well as the temperature of the topside guide 101*u* of the bypass and the underside guide 101*d* of the bypass can be reduced. Since increase of the temperature of the bypass Pb (and the topside guide 101*u* of the bypass and the underside guide 101*d* of the bypass) is reduced, the toner image fixed on a sheet by the first fixing device 20 is prevented from melting caused by a temperature rise of the bypass Pb, so that image deterioration is prevented. Accordingly, even when a sheet passes through the bypass Pb, the sheet can be conveyed smoothly.

As described above, the first embodiment is configured such that the guide 100*d* under the main path, the under-surface of the case 21*b* of the second fixing device 21, and the topside guide 101*u* of the bypass constitute the flow path (duct) when the air is moved by the fan F. However, other configurations can be used. For example, a first modified example shown in FIGS. 4–6 and described below includes a duct formed by different members than those of the first embodiment shown in FIGS. 1–3 and described above.

Figure 4:
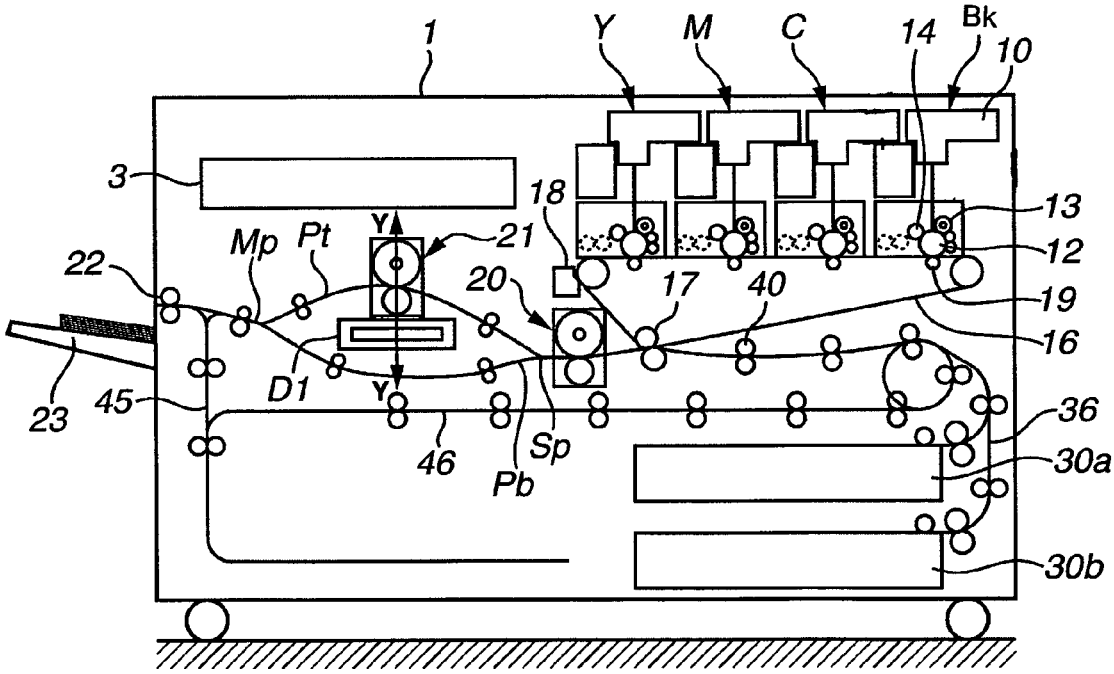
FIG. 4 is a schematic cross-sectional view showing a first modified example of an image forming apparatus of the first embodiment.
Figure 5:
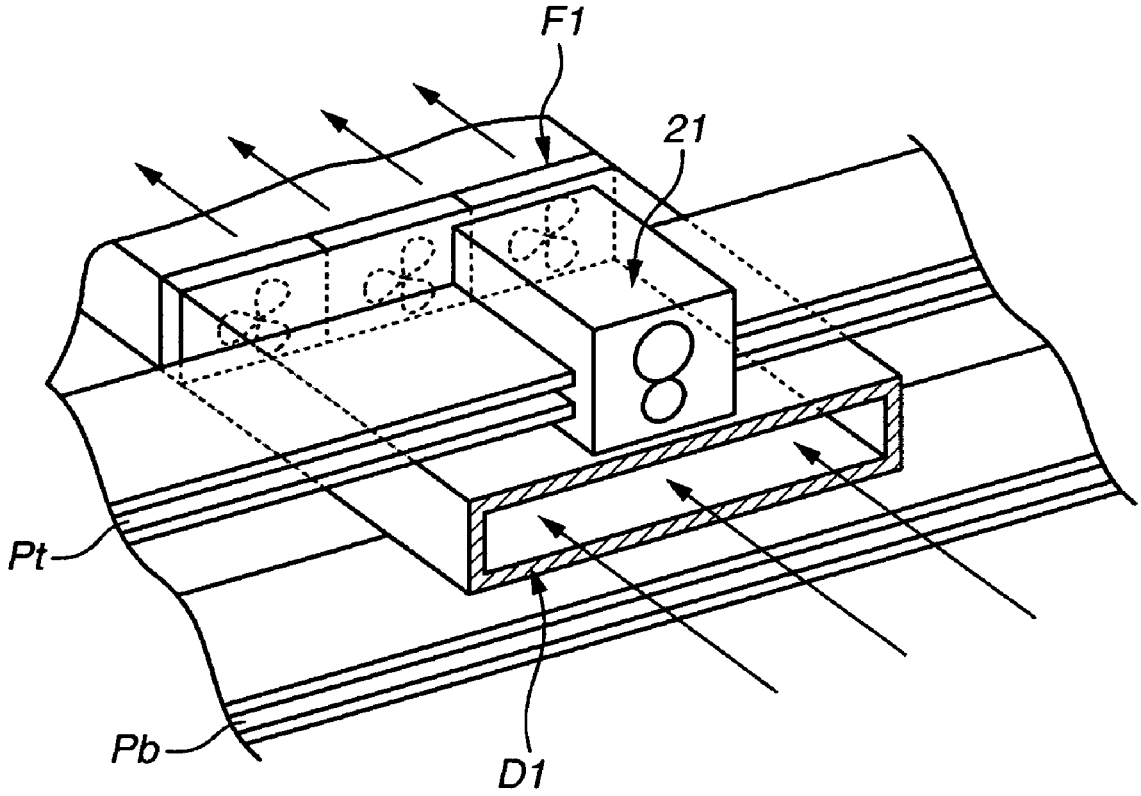
FIG. 5 is a perspective view showing a structure of a periphery of the second fixing device in the first modified example of the first embodiment.
Figure 6:
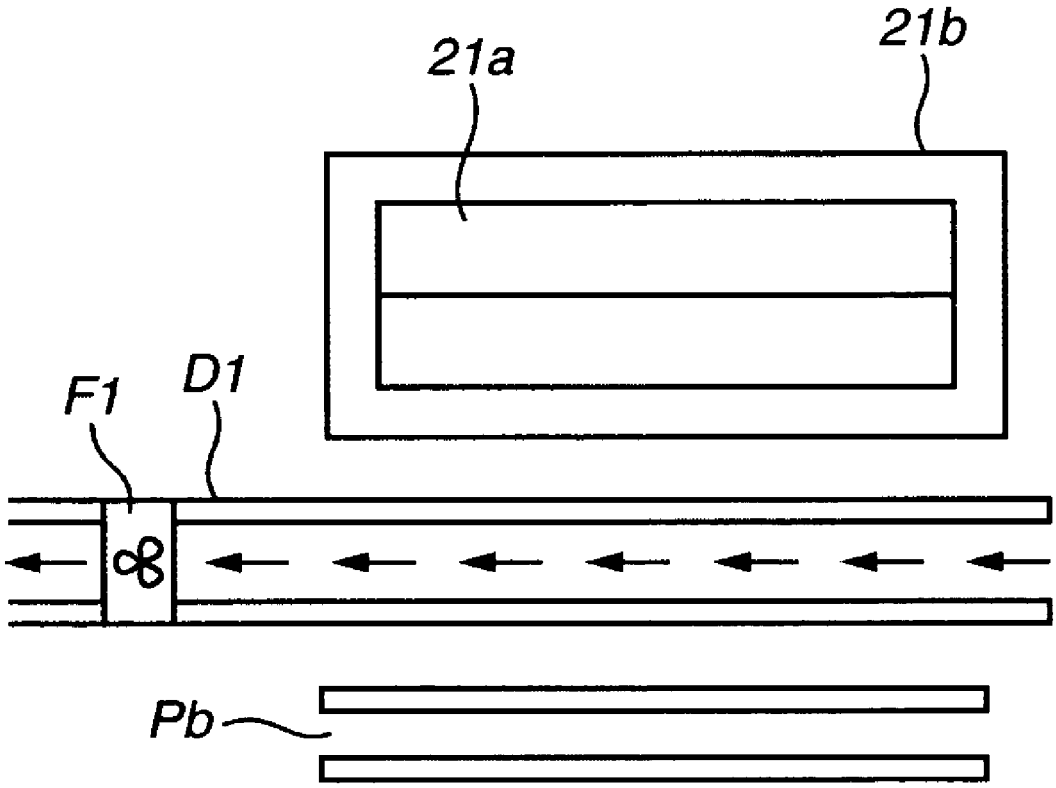
FIG. 6 is a cross-sectional view in the first modified example of the first embodiment.

FIG. 4 is a cross-sectional view showing the first modified example in which a duct D1 of a fan F1 is provided differently in an image forming apparatus. FIG. 5 is a perspective view showing a structure of a periphery of the second fixing device 21 in the image forming apparatus of FIG. 4. FIG. 6 is a cross-sectional view, taken along section line Y—Y of FIG. 4.

The duct D1 is provided between the second fixing device 21 and the bypass Pb. The fan F1 is disposed inside the duct D1. The fan F1 moves air inside the duct D1 and exhausts it to the outside of the image forming apparatus 1. By airflow of the fan F1, heat of the second fixing device 21 is prevented from being conveyed to the bypass Pb.

By providing the duct D1 differently, the air moved by the fan F1 is limited to the inside of the duct D1. Therefore, in the first modified example, transfer sections that can be adversely affected by the airflow of the fan F can be reduced compared to that of the first embodiment shown in FIGS. 1–3 and described above.

When the duct D1 is made by a heat insulation member, for example, a resin whose heat conductivity is low, heat of the second fixing device 21 can be further prevented from influencing the bypass Pb. In addition, in this case, a heat insulation member prevents the heat generated from the second fixing device 21 from being transmitted to the bypass Pb without providing a fan. That is, it can be formed that the heat insulation member is provided between the second fixing device 21 and the bypass Pb instead of the airflow by the fan.

Figure 7:
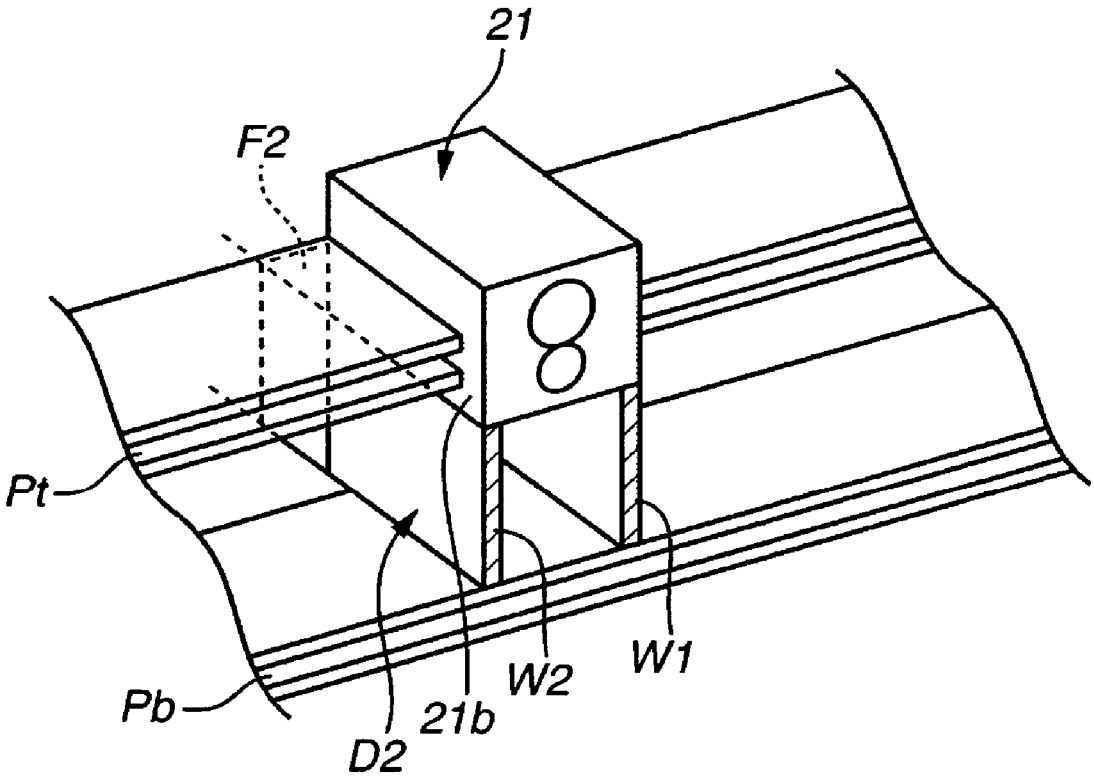
FIG. 7 is a perspective view showing a structure of a periphery of the second fixing device in a second modified example of the first embodiment.

FIG. 7 is a perspective view showing a second modified example of a flow path. In the second modified example shown in FIG. 7, the air flow path created by a fan F2 is composed of the under-surface of the case 21*b* of the second fixing device 21, the topside guide 101*u* of the bypass Pb, and a pair of side walls W1, W2, which extends upwardly between the second fixing device 21 and the bypass Pb. Also in the second modified example, the side wall W1 prevents an air stream created by the fan F2 from appearing in the image forming section side. Accordingly, similarly to the first modified example, adverse influence of the air stream of the fan over the image forming sections can be avoided. Further, since the under-surface of the duct D2 is formed by the topside guide 101*u* of the bypass, the airflow from the fan F2 passes through the topside guide 101*u* of the bypass. Therefore, the topside guide 101*u* of the bypass is cooled when the airflow passes through the topside guide 101*u* of the bypass and temperature rise of the bypass Pb and the topside guide 101*u* of the bypass can be further prevented.

In any of forms described above, since the bypass Pb is provided in the outside of the projection area located vertically in an upper direction with respect to the second fixing device 21 that the bypass Pb bypasses, image deterioration, transport defect, or the like caused by heat from the second fixing device 21 on the bypass Pb is prevented.

Effects in the first embodiment will be described in detail below. In a case where the bypass Pb is positioned above the second fixing device 21, a phenomenon occurs in which water vapor generated from a sheet at the time of fixing by the second fixing device 21 that the bypass Pb bypasses adheres to the bypass Pb at low temperature so that the water vapor is liquefied again to become droplets of water. Since the bypass Pb at low temperature is exposed to the heat flow coming from the second fixing device 21, its temperature rises, and vapor in the air around the bypass Pb is liquefied to adhere to the bypass Pb (a so-called condensation phenomenon). Although these two phenomena do not occur when the temperature of the bypass Pb is relatively high, in a case where temperature in its periphery is low when the power of the image forming apparatus 1 is turned on, therefore, the temperature inside the bypass Pb is also low, the phenomena appear remarkably with an abrupt temperature rise in the bypass Pb caused by the second fixing device 21.

When the phenomena occur, droplets of water adhere to a sheet transported on the bypass Pb to cause image disorder, and a problem occurs in that droplets of water become a transport resistance which causes a jam or the like.

The first embodiment solves these problems, and the following effects are expected.

(1) Constantly stable image formation can be expected without causing image deterioration.

(2) Occurrence frequency of a transport jam or the like is reduced.

As a result, a user does not have to stop the work due to a transport jam. Further, reliability on to the maker is improved, and satisfaction degree of both users and makers with respect to a product is improved.

Second Embodiment

A structure in which a bypass passes through a portion under the second fixing device was described above with reference to the first embodiment. A second embodiment of the present invention is described below in which a bypass passes through a portion above the second fixing device.

Figure 8:
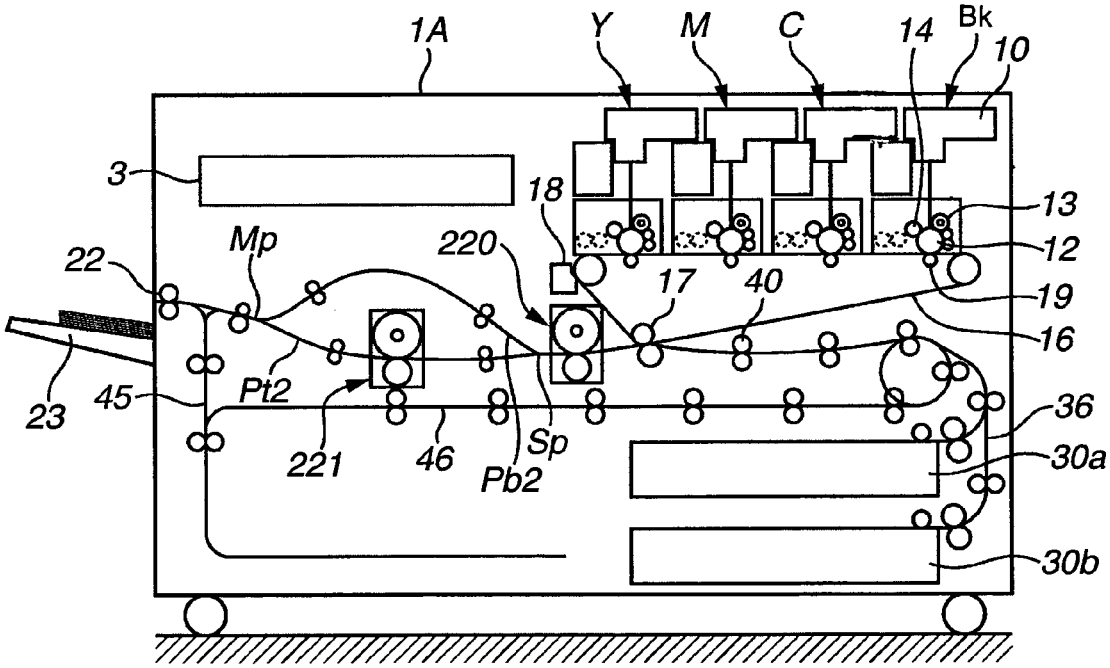
FIG. 8 is a schematic cross-sectional view of an image forming apparatus according to a second embodiment of the present invention.

FIG. 8 is a cross-sectional view of an image forming apparatus 1A of the second embodiment. The same reference characters are designated to members similar to those in the first embodiment, and we omit description thereof.

As shown in FIG. 8, a transport path branches at a diverging point Sp to a main path Pt2 that is a main transport path going to a second fixing device 221 and to a bypass Pb2 that is a bypass transport path which bypasses the second fixing device 221 on a downstream side of a first fixing device 220. The main path Pt2 and the bypass Pb2 merge again at a merging point Mp on a downstream side of the second fixing device 221.

The structures of the first fixing device 220 and the second fixing device 221 are the same as those of the first fixing device 20 and the second fixing device 21 of the first embodiment, respectively.

Most of heat of the second fixing device 221 becomes convection heat which flows toward an upper part of the second fixing device 221. Accordingly, in a case where the bypass Pb2 is disposed in an upper part of the second fixing device 221 as shown in the second embodiment, the bypass Pb2 is easily influenced by heat of the second fixing device 221. Thus, a heat exhausting mechanism for exhausting heat of the second fixing device 221 is provided.

Figure 9:
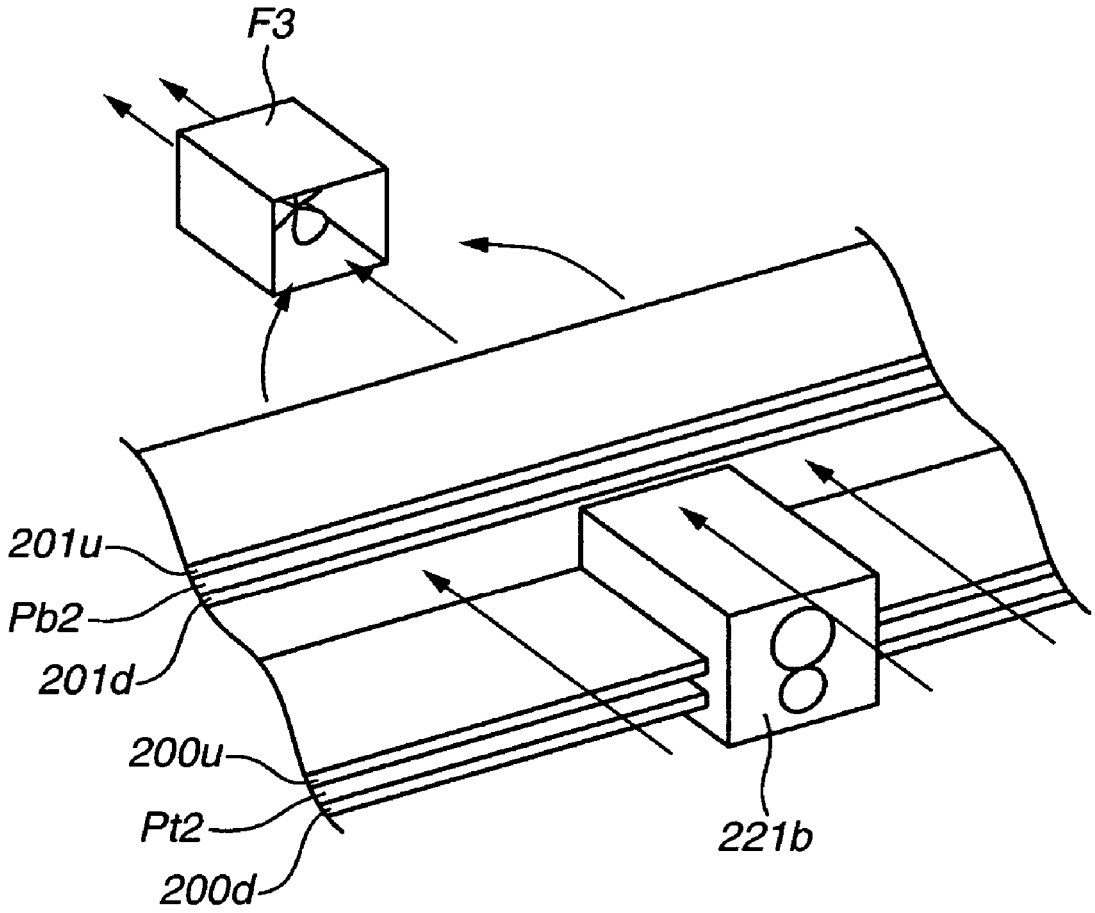
FIG. 9 is a perspective view showing a structure of a periphery of the second fixing device in the second embodiment.

FIG. 9 is a perspective view of a periphery around the second fixing device 221 for describing the heat discarding mechanism. A fan F3 is provided in the fixing apparatus, for discharging heat from the second fixing device 221 by conveying air between the second fixing device 221 and the bypass Pb2.

As shown in FIG. 9, the main path Pt2 is formed by a topside guide 200*u* of the main path and an underside guide 200*d* of the main path. The bypass Pb2 is formed by a topside guide 201*u* of the bypass and an underside guide 201*d* of the bypass.

The fan F3 moves air between the second fixing device 221 and the bypass Pb2 in directions shown by the arrows in FIG. 9 to be discharged to the outside of the image forming apparatus 1A. Since air between the second fixing device 221 and the bypass Pb2 is discharged, heat of the air between the second fixing device 221 and the bypass Pb2 is discharged to the outside. An upper surface of the topside guide 200*u* of the main path, an upper surface of a case 221*b* of the second fixing device 221, and an under-surface of the underside guide 201*d* of the bypass constitute a flow path (duct) when the air is moved by the fan F3.

Figure 10:
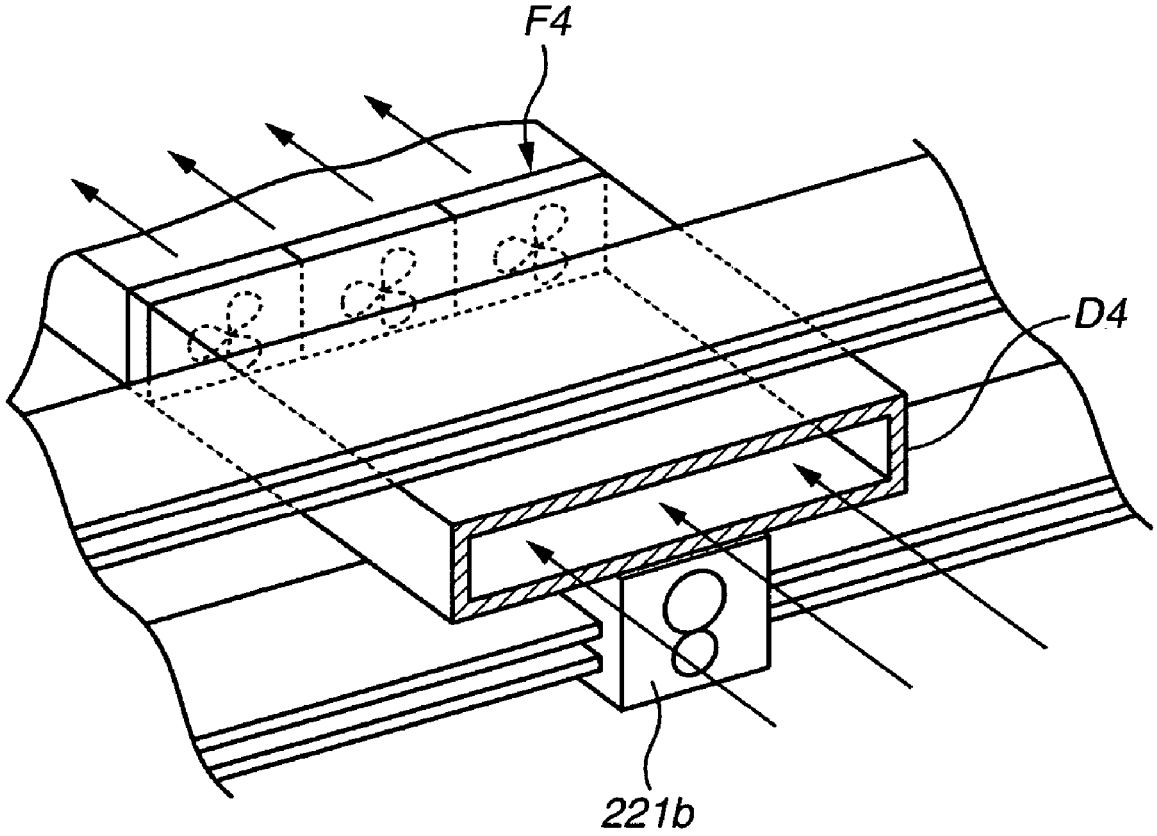
FIG. 10 is a perspective view showing a structure of a periphery of the second fixing device in a first modified example of the second embodiment.

As in a first modified example shown in FIG. 10, a duct D4 for the fan may be provided differently between the bypass Pb2 and the second fixing device 221. In the modified example of FIG. 10, an air stream is generated inside the duct D4 by the fan F4. The air stream generated by the duct D4 is created by moving the air between the bypass Pb2 and the second fixing device 221 to the outside of the image forming apparatus 1A. When the duct D4 is made of a heat insulation member, for example, by a resin whose heat conductivity is low, heat of the second fixing device 221 can be further prevented from influencing the bypass Pb. In addition, in this case, the heat insulation member prevents the heat generated from the second fixing device 221 from being transmitted to the bypass Pb2 without providing a fan. That is, it can be formed that the heat insulation member is provided between the second fixing device 221 and the bypass Pb2 instead of the airflow by the fan.

Figure 11:
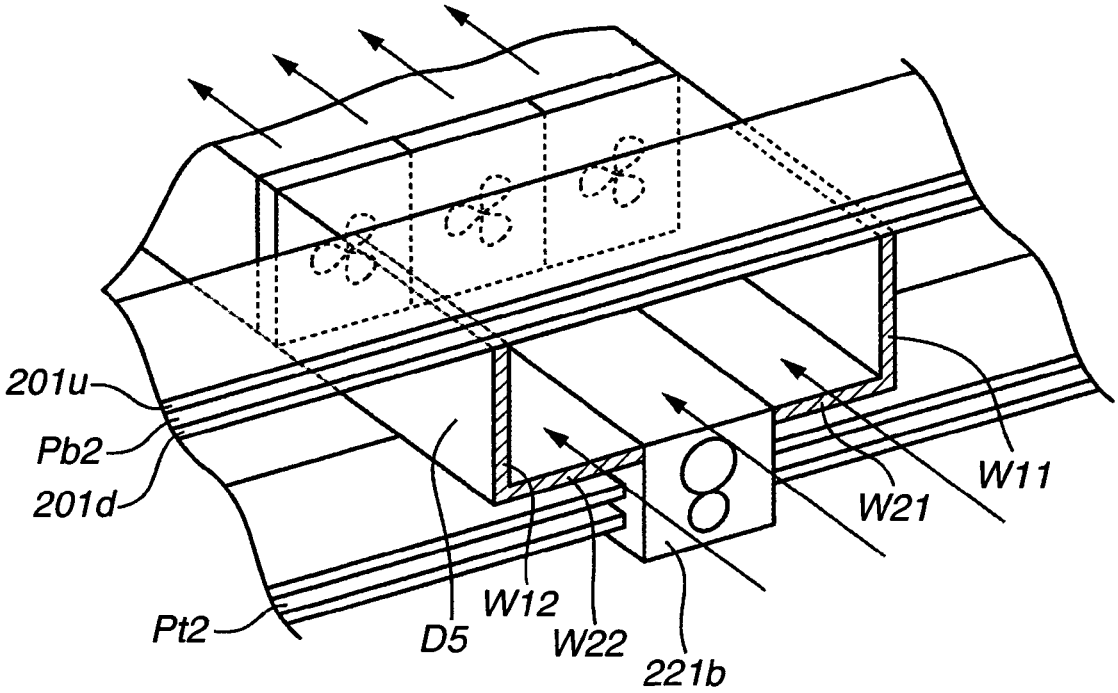
FIG. 11 is a perspective view showing a structure of a periphery of the second fixing device in a second modified example of the second embodiment.

Further, a duct D5 may be provided as in a second modified example shown in FIG. 11. In the structure of FIG. 11, the duct D5 is disposed between the bypass Pb2 and the second fixing device 221. The duct D5 is formed by the upper surface of the case 221*b* of the second fixing device 221, the under-surface of the underside guide 201*d* of the bypass, a pair of continuous walls W21, W22 which are parallel to the upper surface of the case 221*b* and which continue on with the upper surface of the case 221*b*, and a pair of side walls W11, W12 which respectively extend upwardly from respective end portions of the continuous walls W21, W22.

In any of the embodiments, the distance between the bypass and the second fixing device and the flow rate of the fan can be set such that the temperature inside the bypass does not become more than that of a melting start temperature of a toner (e.g., 75° C.).

In any of the embodiments, although the first fixing device and the second fixing device have the fixing roller pairs as an example, either one of the fixing devices or both of the fixing devices may have a rotating belt and a roller.

In any of the embodiments, although two fixing devices are provided, as an example, a fixing apparatus can be adopted which is provided with three or more fixing devices and has a bypass for bypassing at least one fixing device among the three fixing devices.

In any of the embodiments described above, the bypass merges with the main path at the merging point Mp as an example. However, the present invention can be applied also where the bypass does not merge with the main path and paper discharging trays are disposed at ends of respective paths. Specifically, in a case where the bypass and the main path are substantially parallel to each other, there is a fear that the bypass is influenced by heat of a fixing device that a bypass bypasses. However, as described in the above embodiments, by generating an air stream between a bypass and a fixing device that the bypass bypasses, influence of the heat of the fixing device on the bypass can be reduced.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-110183 filed Apr. 2, 2004, which is hereby incorporated by reference herein.

What is claimed is:

1. A fixing apparatus comprising:

two fixing devices that fix a toner image on a sheet using heat;

a main transport path that transports the sheet via the two fixing devices;

a bypass transport path that branches from the main transport path and transports the sheet so that the sheet bypasses one of the two fixing devices; and a fan that moves air between the bypass transport path and the fixing device that the sheet transported by the bypass transport path bypasses, wherein a transporting direction of a part of the main transport path in which the fixing device that the sheet transported by the bypass transport path bypasses is disposed and a transporting direction of the bypass transport path are substantially the same.

2. A fixing apparatus according to claim 1, wherein the air moved by the fan is moved to outside of the fixing apparatus.

3. A fixing apparatus according to claim 1, wherein the fixing device that the sheet transported by the bypass transport path bypasses is provided with a case, and a surface of the case serves as a part of a duct for allowing an air stream generated by the fan to pass through.

4. A fixing apparatus according to claim 1, wherein the fixing device that the sheet transported by the bypass transport path bypasses is provided with a rotator pair for transporting the sheet, and the fan generates an air stream which is substantially parallel to the axial direction of the rotator pair.

5. A fixing apparatus according to claim 1, wherein the bypass transport path is provided outside of a projection area located vertically in an upper direction with respect to the fixing device that the sheet transported by the bypass transport path bypasses.

6. A fixing apparatus according to claim 1, wherein the bypass transport path is provided such that a sheet passes through a portion above the fixing device that the sheet transported by the bypass transport path bypasses.

7. A fixing apparatus according to claim 1, wherein the fan faces to an area between the bypass transport path and the fixing device that the sheet transported by the bypass transport path bypasses.

8. A fixing apparatus according to claim 1, wherein the fixing device that the sheet transported by the bypass transport path bypasses is provided with a rotator pair for transporting the sheet, and the fan generates an air stream which is substantially parallel to the axial direction of the rotator pair, and wherein the fan is provided in a projection area located in the axial direction of the rotator pair with respect to the space between the bypass transport path and the fixing device and the sheet transported by the bypass transport path bypasses.

9. A fixing apparatus comprising:

two fixing devices that fix a toner image on a sheet using heat;

a main transport path that transports the sheet via the two fixing devices;

a bypass transport path that branches from the main transport path and transports the sheet so that the sheet bypasses one of the two fixing devices; and a heat insulator that prevents heat generated from the fixing device that the sheet transported by the bypass transport path bypasses from being transmitted to the bypass transport path.

10. A fixing apparatus according to claim 9, wherein the bypass transport path is provided outside of a projection area located vertically in an upper direction with respect to the fixing device that the sheet transported by the bypass transport path bypasses.

11. A fixing apparatus according to claim 9, wherein the bypass transport path is provided such that a sheet passes through a portion above the fixing device that the sheet transported by the bypass transport path bypasses.

12. A fixing apparatus according to claim 9, wherein the bypass transport path branches from the main transport path on an upstream side of the fixing device that the sheet transported by the bypass transport path bypasses and merges with the main transport path on a downstream side of the fixing device that the sheet transported by the bypass transport path bypasses.

13. An image forming apparatus comprising:

a transfer unit for transferring the image onto the sheet and a fixing apparatus according to claim 9 which fixes the image transferred by the transfer unit onto the sheet.

14. A fixing apparatus according to claim 9, wherein the transporting direction of a part of the main transport path in which the fixing device that the sheet transported by the bypass transport path bypasses is disposed and the transporting direction of the bypass transport path are substantially the same.

15. A fixing apparatus comprising:

two fixing devices that fix a toner image on a sheet using heat;

a main transport path that transports the sheet via the two fixing devices;

a bypass transport path that branches from the main transport path and transports the sheet so that the sheet bypasses one of the two fixing devices;

a fan that moves air between the bypass transport path and the fixing device that the sheet transported by the bypass transport path bypasses; and a transport guide which forms the bypass transport path and serves as a portion of a duct for allowing an air stream generated by the fan to pass through.

16. A fixing apparatus according to claim 15, wherein the fan faces to an area between the bypass transport path and the fixing device that the sheet transported by the bypass transport path bypasses.

17. A fixing apparatus comprising:

two fixing devices that fix a toner image on a sheet using heat;

a main transport path that transports the sheet via the two fixing devices;

a bypass transport path that branches from the main transport path and transports the sheet so that the sheet bypasses one of the two fixing devices; and a fan that moves air between the bypass transport path and the fixing device that the sheet transported by the bypass transport path bypasses;

wherein the bypass transport path branches from the main transport path on an upstream side of the fixing device that the sheet transported by the bypass transport path bypasses and merges with the main transport path on a downstream side of the fixing device that the sheet transported by the bypass transport path bypasses.

18. A fixing apparatus according to claim 17, wherein the fan faces to an area between the bypass transport path and the fixing device that the sheet transported by the bypass transport path bypasses.

19. A fixing apparatus according to claim 17, wherein the fixing device that the sheet transported by the bypass transport path bypasses is provided with a rotator pair for transporting the sheet, and the fan generates an air stream which is substantially parallel to the axial direction of the rotator pair, and wherein the fan is provided in a projection area located in the axial direction of the rotator pair with respect to the space between the bypass transport path and the fixing device and the sheet transported by the bypass transport path bypasses.

* * * * *